US008737673B2

(12) United States Patent
Lee et al.

(10) Patent No.: US 8,737,673 B2
(45) Date of Patent: May 27, 2014

(54) HIDDEN SPEAKER APPARATUS

(75) Inventors: Gyeong-tae Lee, Uiwang-si (KR); Jong-bae Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 899 days.

(21) Appl. No.: 12/535,857

(22) Filed: Aug. 5, 2009

(65) Prior Publication Data

US 2010/0124351 A1 May 20, 2010

(30) Foreign Application Priority Data

Nov. 14, 2008 (KR) ..... 10-2008-0113350

(51) Int. Cl.
*H04R 1/02* (2006.01)

(52) U.S. Cl.
USPC ..... 381/387; 381/87; 381/333

(58) Field of Classification Search
USPC ..... 381/337, 338, 386, 387, 334, 87, 333, 381/339, 340, 306; 181/151, 152; 348/836; D14/194, 204, 221, 224
See application file for complete search history.

(56) References Cited

U.S. PATENT DOCUMENTS

| | | | | | |
|---|---|---|---|---|---|
| 4,823,391 | A * | 4/1989 | Schwartz | 381/103 |
| 4,926,487 | A * | 5/1990 | Yoshida et al. | 381/186 |
| 5,274,709 | A * | 12/1993 | Koizumi | 381/306 |
| 5,737,435 | A | 4/1998 | De Poortere et al. | |
| 5,796,854 | A * | 8/1998 | Markow | 381/385 |
| 5,930,376 | A * | 7/1999 | Markow et al. | 381/333 |
| 6,035,051 | A * | 3/2000 | Sato | 381/340 |
| 6,169,809 | B1 * | 1/2001 | Azima et al. | 381/152 |
| 7,275,621 | B1 | 10/2007 | Delgado, Jr. | |
| 2009/0175472 | A1 * | 7/2009 | Gunnarsson | 381/303 |
| 2009/0196428 | A1 * | 8/2009 | Kim | 381/17 |

* cited by examiner

*Primary Examiner* — Curtis Kuntz
*Assistant Examiner* — Sunita Joshi
(74) *Attorney, Agent, or Firm* — Sughrue Mion, PLLC

(57) ABSTRACT

Provided is a hidden speaker apparatus used as a sound apparatus in a digital TV. The hidden speaker apparatus includes a high range speaker that is disposed such that a sound output direction and a direction to a front side where a listener is present form an acute angle. The high range speaker mitigates high range sound attenuation of the hidden speaker apparatus.

9 Claims, 10 Drawing Sheets

HIDDEN SPEAKER APPARATUS

CROSS-REFERENCE TO RELATED PATENT APPLICATION

This application claims the benefit of Korean Patent Application No. 10-2008-0113350, filed on Nov. 14, 2008, in the Korean Intellectual Property Office, the disclosure of which is incorporated herein in its entirety by reference.

BACKGROUND OF THE INVENTION

1. Field of the Invention

The present general inventive concept relates to a hidden speaker apparatus that is used as a sound apparatus of electronic products such as a digital TV.

2. Description of the Related Art

Recently, as audio and video devices are becoming slimmer, a sound apparatus having a slim structure for the audio and video devices is being released. For example, digital TVs such as LCD TVs or PDP TVs are much slimmer than Braun tube TVs. Thus, a sound apparatus such as a hidden speaker apparatus, which is installed in a place to be invisible from a front side of an electronic product, such as on a lower surface of the electronic product, is used. However, sound output from the hidden speaker apparatus is not directly transmitted to the listener but collides against the surroundings, and thus, the sound may be lost in some ranges.

SUMMARY OF THE INVENTION

According to an aspect of the present general inventive concept, there is provided a hidden speaker apparatus which is installed not to be seen on a front side of an electronic product and outputs sound reproduced by the electronic product, comprising a high range speaker that outputs high range sound among sound and that is disposed such that a sound output direction and a direction to the front side of the electronic product where a listener is present forms an acute angle.

The hidden speaker apparatus may further include a full range speaker that outputs the sound over full ranges including low, mid, and high ranges.

The high range speaker may include: a tweeter that outputs sound; and a horn that guides a sound outputting direction of the tweeter in a direction that forms the acute angle. The hidden speaker apparatus may be arranged such that the sound output from the horn does not directly collide against a main body of the electronic product.

The hidden speaker apparatus may further include a minus equalizer that reduces the amount of high range sound among the sound. The electronic product may be a digital TV.

The high range speaker may be installed under the digital TV so that the sound output at the acute angle is reflected on a bottom surface on which the digital TV is placed and transmitted to a listener.

BRIEF DESCRIPTION OF THE DRAWINGS

The above and other features and aspects of the present general inventive concept will become more apparent by describing in detail exemplary embodiments thereof with reference to the attached drawings in which.

DETAILED DESCRIPTION OF THE INVENTION

The present general inventive concept will now be described more fully with reference to the accompanying drawings, in which exemplary embodiments of the present general inventive concept are shown.

Figure 1:
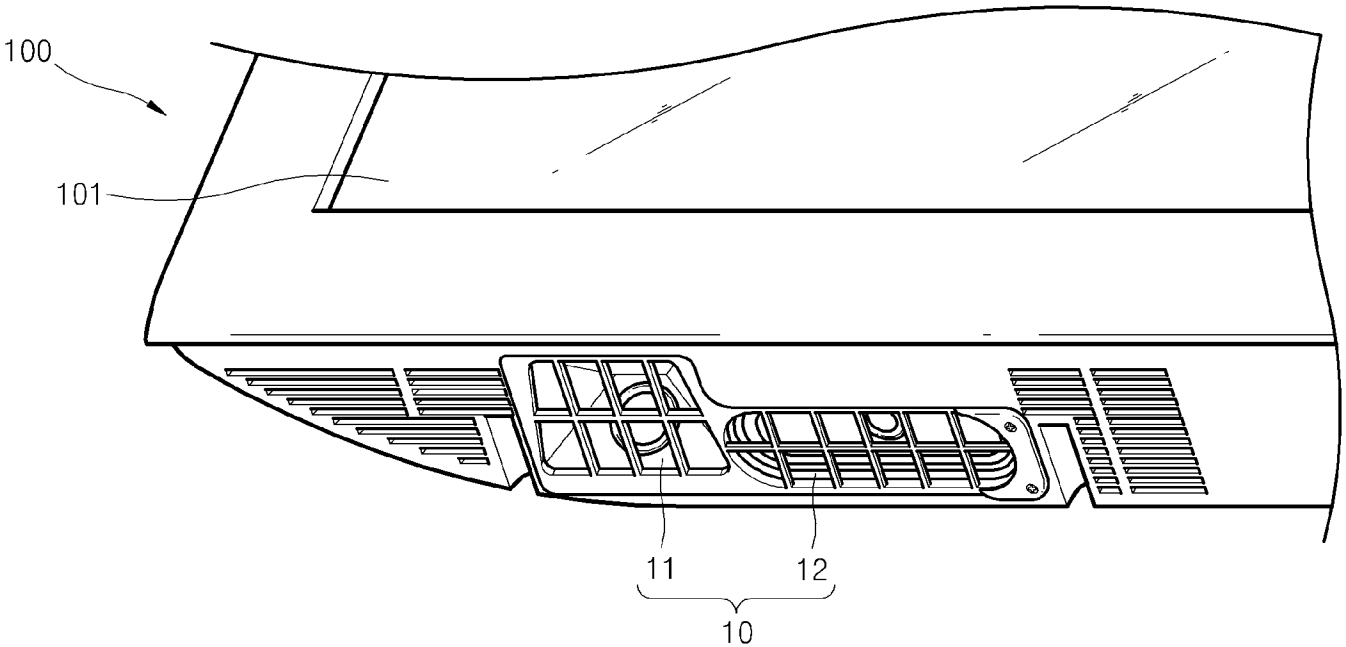
FIG. 1 is a schematic view illustrating a digital TV in which a hidden speaker apparatus, according to an exemplary embodiment of the present general inventive concept, is installed.

FIG. 1 illustrates a lower portion of a digital TV 100 in which a hidden speaker apparatus 10, according to an exemplary embodiment of the present general inventive, concept is installed. Here, the digital TV 100 is merely an example of an electronic product that reproduces sound, and thus other audio or video devices that use a hidden speaker apparatus may also be the electronic product that reproduces sound.

The hidden speaker apparatus 10 is installed on the lower portion of the digital TV 100 such that the hidden speaker apparatus 10 is not seen on a front side where a screen 101 is located. Accordingly, sound output from the hidden speaker apparatus 10 first collides against a bottom surface 30 (see FIG. 2) where the digital TV 100 is placed and than reflected to reach the listener, i.e., the viewer of the digital TV 100. The hidden speaker apparatus 10 includes a high range speaker 11 that outputs high range sound and a full range speaker 12 that outputs sound of all of low, mid, and high ranges.

Figure 2:
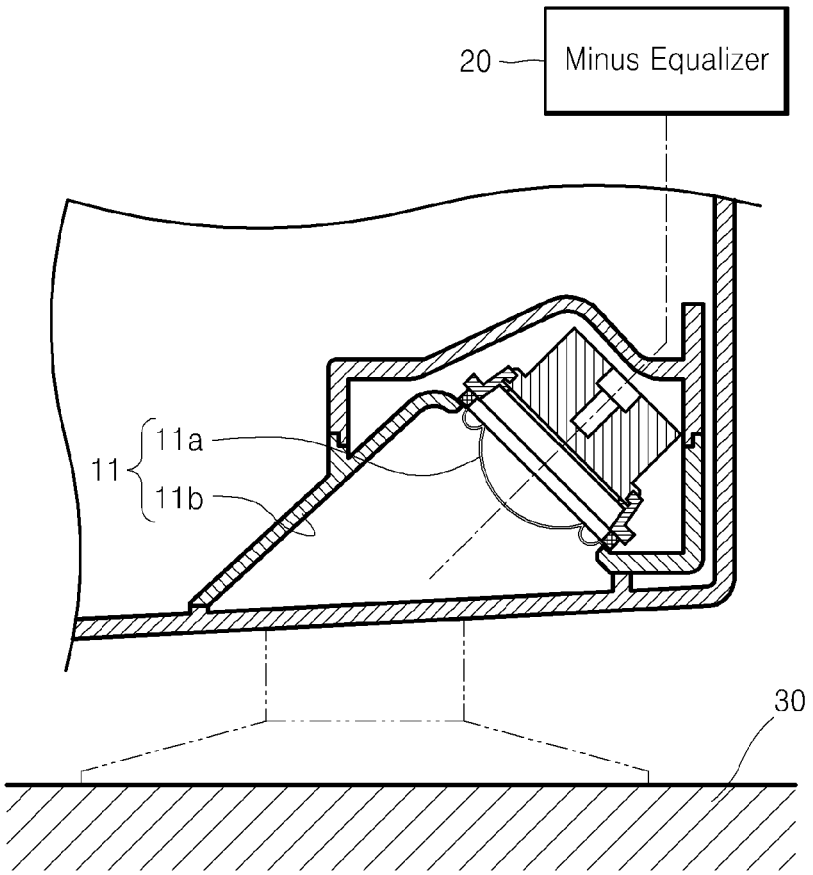
FIG. 2 illustrates the arrangement of a high range speaker in the hidden speaker apparatus illustrated in FIG. 1.

FIG. 2 illustrates the arrangement of the high range speaker 11 in the hidden speaker apparatus 10 illustrated in FIG. 1. Referring to FIG. 2, the high range speaker 11 includes a tweeter 11*a* that outputs high range sound and a horn 11*b* that guides the output sound to proceed with an acute angle to a front side direction where the listener is present. Accordingly, the high range sound output from the tweeter 11*a* is not vertically but obliquely incident on the bottom surface 30 at an acute angle along the horn 11*b* and reflected to reach the listener. The sound output from the horn 11*b* needs to be disposed not to directly collide against a main body of the digital TV 100 in order to prevent diffraction. In other words, if the sound output obliquely from the horn 11*b* collides against a panel of the screen 101, diffraction is generated at a point of collision and works as another sound source, and this may decrease sound quality. Thus, the direction of the horn 11*b* is disposed to form an acute angle with the output sound so that the output sound does not directly collide against the main body of the digital TV.

When the high range speaker 11 is arranged such that sound is reflected at an acute angle, offset which is generated when high range sound is incident or reflected on a reflection surface (e.g., the bottom surface 30) and attenuation caused thereby can be prevented.

Hereinafter, the reasons for the above effect will be described.

Figure 3:
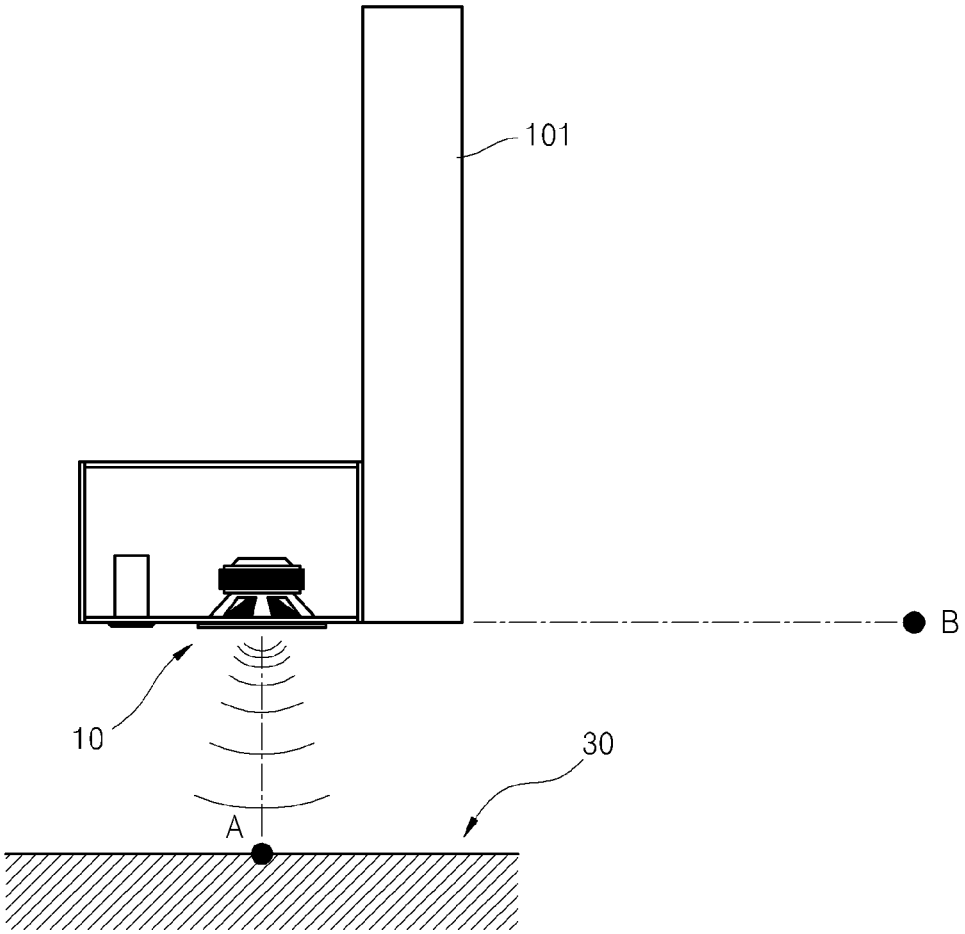
FIG. 3 is a schematic view for explaining the attenuation principle of high range sound in the hidden speaker apparatus as illustrated in FIG. 1.
Figure 4A:
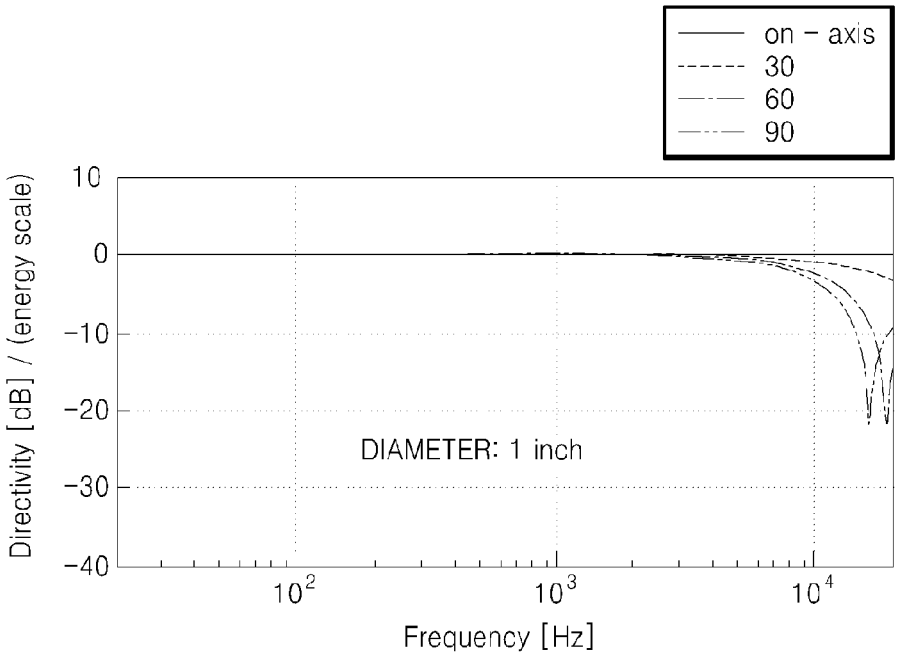
FIGS. 4A through 4D are graphs showing attenuation degrees of sound according to diameters of vibration plates of a speaker and an off-axis angle.
Figure 4B:
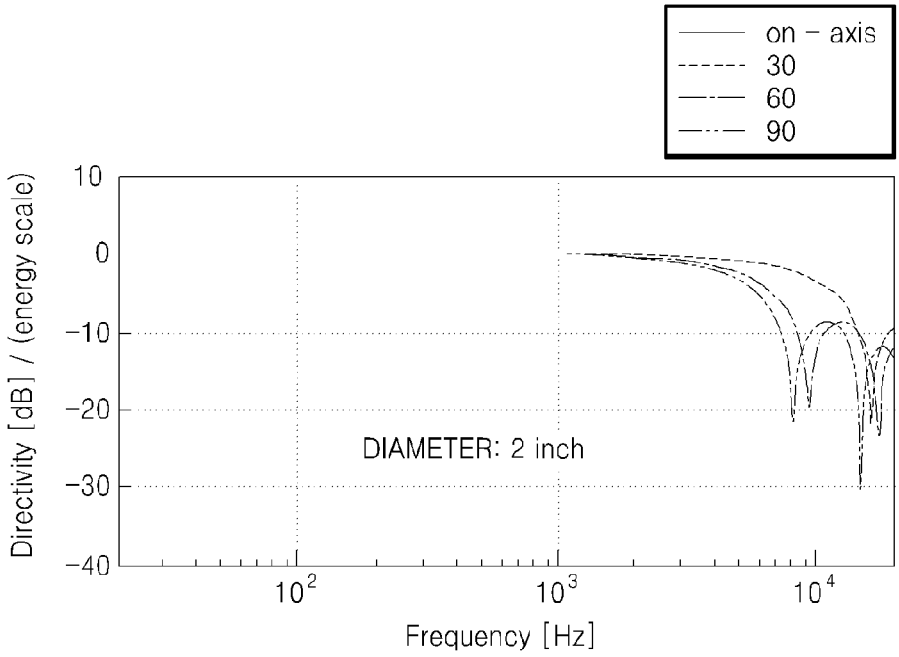
Figure 4C:
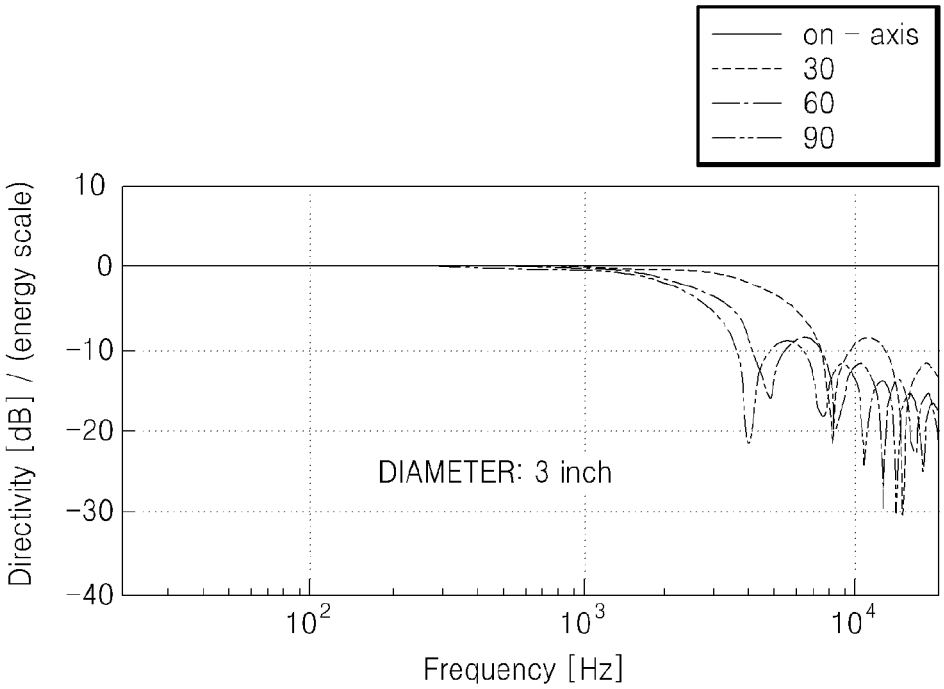
Figure 4D:
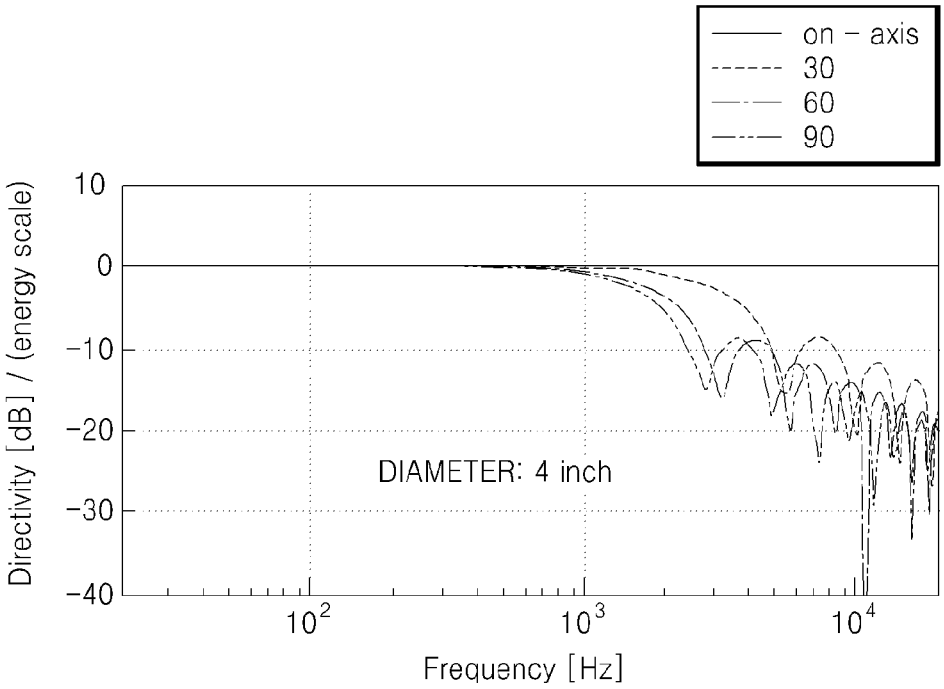
Figure 5A:
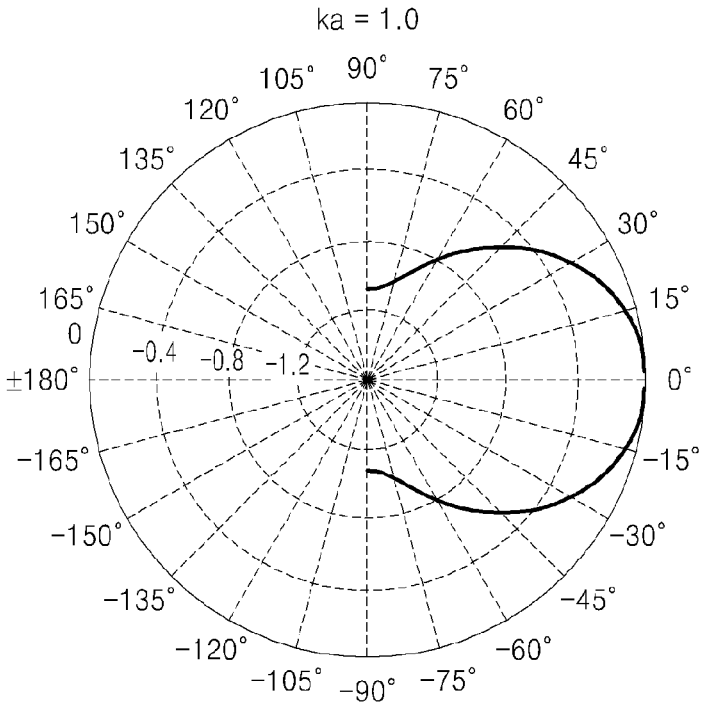
FIGS. 5A through 5F are graphs showing directivity according to the diameter of the speaker vibration plate and the wave number.
Figure 5B:
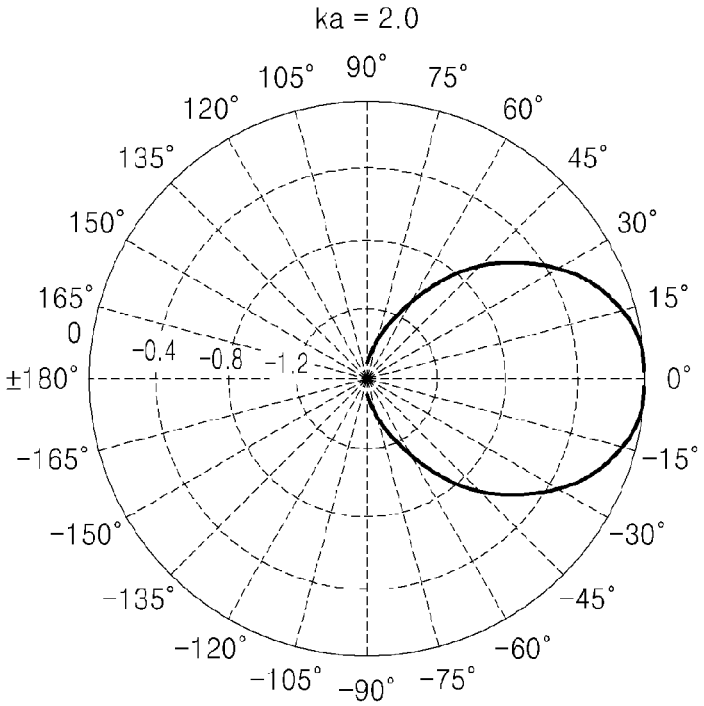
Figure 5C:
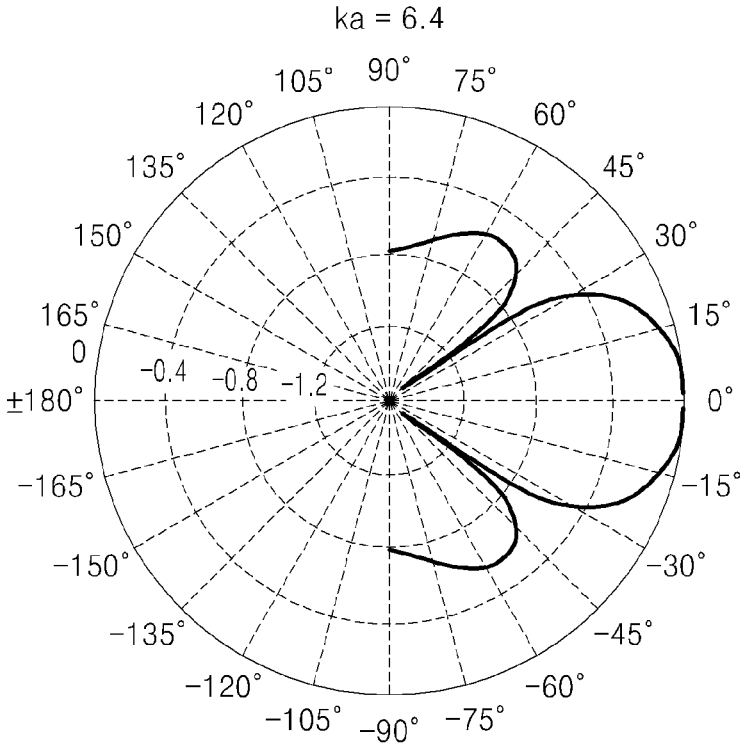
Figure 5D:
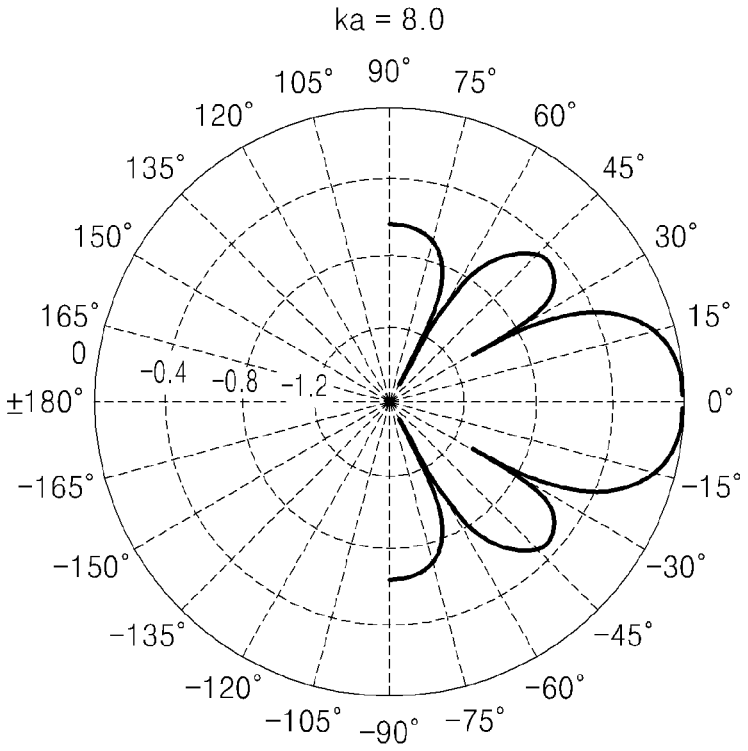
Figure 5E:
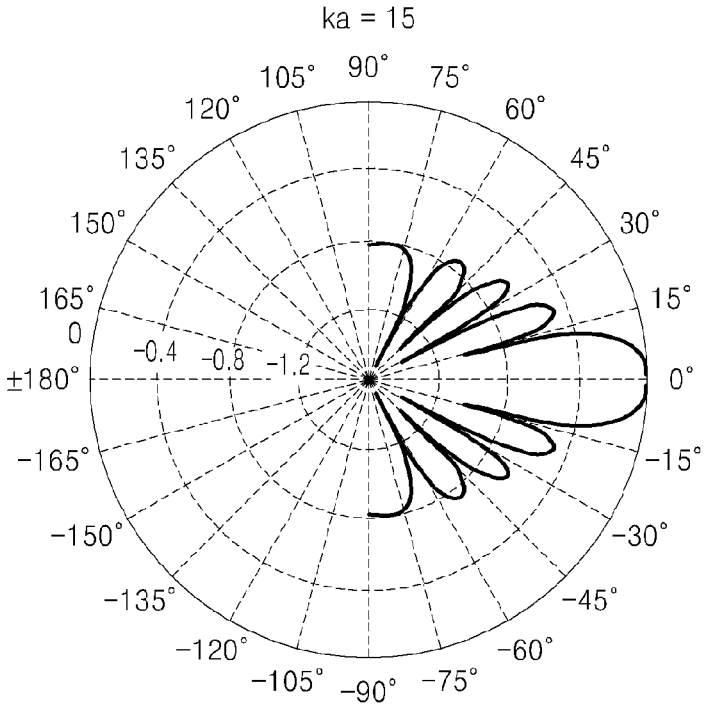
Figure 5F:
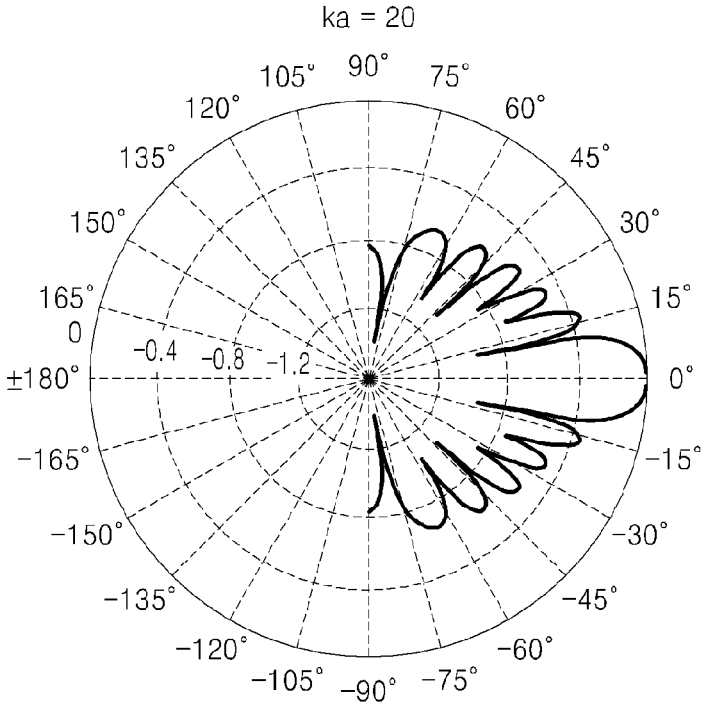

FIG. 3 is a schematic view for explaining the attenuation principle of high range sound in the hidden speaker apparatus 10 as illustrated in FIG. 1. For example, it is assumed that the hidden speaker apparatus 10 is arranged to face the bottom surface 30 on which the digital TV 100 is placed, that is, that sound is incident vertically on the bottom surface 30 on which the digital TV 100 is placed, as conventionally performed. In such case, sound output from the hidden speaker apparatus 10 is vertically incident on the bottom surface 30 and is reflected and diffused. If the listener is at position A, that is, on the bottom surface 30, the listener may hear sound without any loss. However, in reality, the listener is at position B, in a front side, and thus, hears attenuated sound that is offset from being incident and reflected. Here, the position A where a sound output direction and a direction toward the listener are identical is referred to as a 0 degree off-axis angle (on-axis), and the position B where the sound output direction and the direction toward the listener are perpendicular to each other is referred to as a 90 degree off-axis angle. It can be predicted that when the off-axis angle increases from the position A to the position B, attenuation of sound in some ranges becomes severe due to the offset of the sound, and when the off-axis angle decreases from the position B to the position A, the sound attenuation is decreased. Obviously, since it is a hidden speaker apparatus, a 0 degree off-axis is not possible in reality.

In addition, the increase in a diameter of a vibration plate of the hidden speaker apparatus 10 may be the cause of sound attenuation in some ranges. That is, in the case of a speaker that outputs full range sound including low and mid ranges, a vibration plate thereof is at least 2 inches in diameter, and if the vibration plate is this large, the vibration of an outer portion of the vibration plate is too late as compared to the vibration of a center portion of the vibration plate during short periodic vibrations in a high range. Accordingly, vibration timings may cross each other and sound may not be output properly, which is referred to as break-up. In other words, the center portion of the vibration plate may vibrate toward the outside; however, the outer portion of the vibration plate may vibrate toward the inside. Thus, it can be predicted that if the diameter of the vibration plate is small, a distance between the center portion and the outer portion of the vibration plate is also small, and thus, the crossing of the vibrations of the center portion and the outer portion is reduced.

FIGS. 4A through 4D are graphs showing attenuation degrees of sound according to diameters of the vibration plates and the off-axis angle. The diameters of the vibration plate were 1, 2, 3, and 4 inches, respectively, and the attenuation degree of sound in each case was simulated at an off-axis angle of 0, 30, 60, and 90 degrees. As a result, as illustrated in FIGS. 4A through 4D, as the diameter of the vibration plate is increased, the area of the high range sound region in which attenuation is generated is broadened. Also, with the same diameter of the vibration plate, the attenuation becomes intense as the off-axis angle increases. Accordingly, sound attenuation in the high range can be reduced when a speaker having a diameter as small as possible is used and the off-axis angle is reduced to be smaller than 90 degrees. The reason that attenuation is preeminent in the high range is regarded to be the phase difference that is easily generated between an incident wave and a reflection wave due to the fact that the high range is a range where periods of sound waves are short. The high range here refers to a sound range of 1 kHz or greater among an audible frequency of 20 Hz-20 kHz.

FIGS. 5A through 5F are graphs showing attenuation degrees of sound according to another method. In this simulation, attenuation was calculated according to the off-axis angle, that is, according to directivity index (DI) at an angle from +90 degrees to an angle of −90 degrees, starting from the 0 degree off-axis angle where the listener is assumed to be present. Also, k refers to a wave number, a refers to a radius of a vibration plate, and if k is constant, more attenuation is generated according to an off-axis angle as a increases; and if a is constant, more attenuation is generated as k increases, that is, toward the high range.

Based on these results, it can be concluded that attenuation is likely to occur in the hidden speaker apparatus 10 in the high range, and that a speaker apparatus having a vibration plate as small as possible needs to be used and arranged at an acute off-axis angle smaller than 90 degrees to solve this problem.

Figure 6:
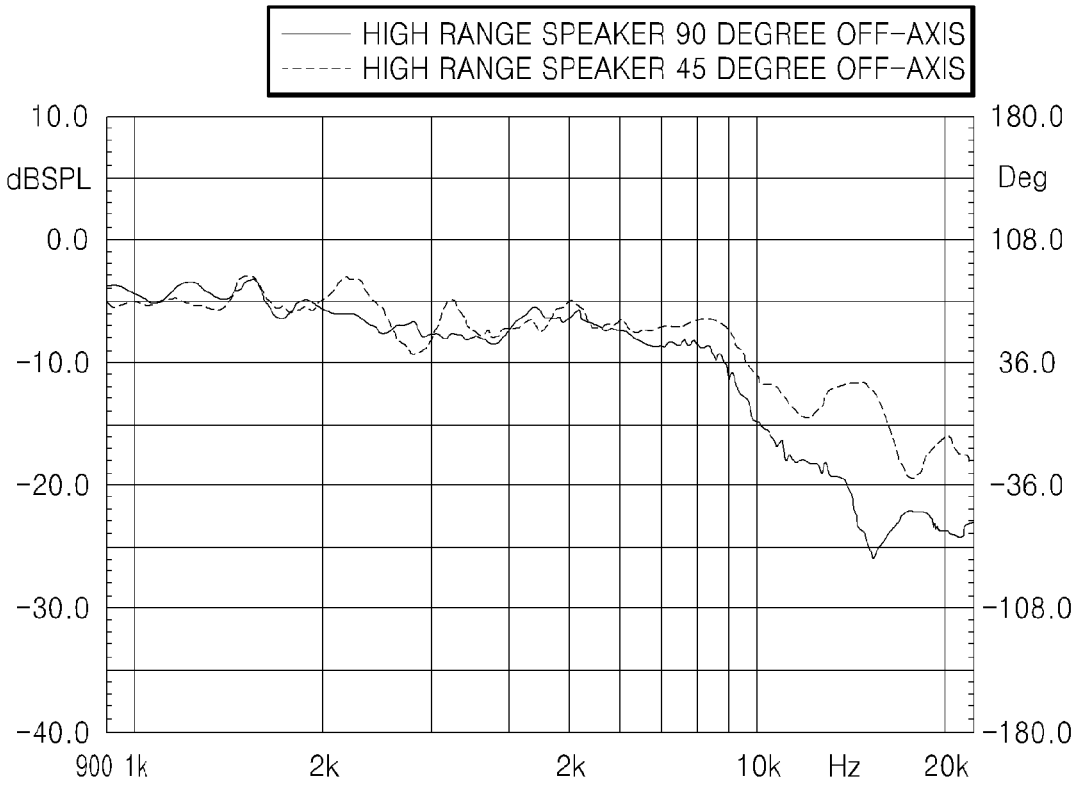
FIG. 6 is a graph showing sound attenuation degrees of sound in cases where a high range speaker illustrated in FIG. 1 is arranged at an off-axis angle of 90 degrees and at an off-axis angle of 45 degrees.

Thus, according to the current exemplary embodiment, the high range speaker 11, which outputs high range sound with frequent attenuation, is additionally installed as described above with reference to FIGS. 1 and 2, and the off-axis angle is set as an acute angle of about 45 degrees. Comparing the current exemplary embodiment in which the off-axis angle is set to be 45 degrees to a case in which an off-axis angle is 90 degrees, it can be seen that attenuation in the high range is significantly reduced in the current exemplary embodiment as shown in FIG. 6, which is a graph showing attenuation degrees of sound in cases where the high range speaker 11 illustrated in FIG. 1 is arranged at an off-axis angle of 90 degrees and at an off-axis angle of 45 degrees, respectively.

Consequently, when the high range speaker 11 is installed at an acute angle, in addition to the full range speaker 12, in the hidden speaker apparatus 10, the attenuation in the high range is compensated for by the high range speaker 11 and thus, the listener can still hear clear sound in the full frequency range using the hidden speaker apparatus 10.

Figure 7:
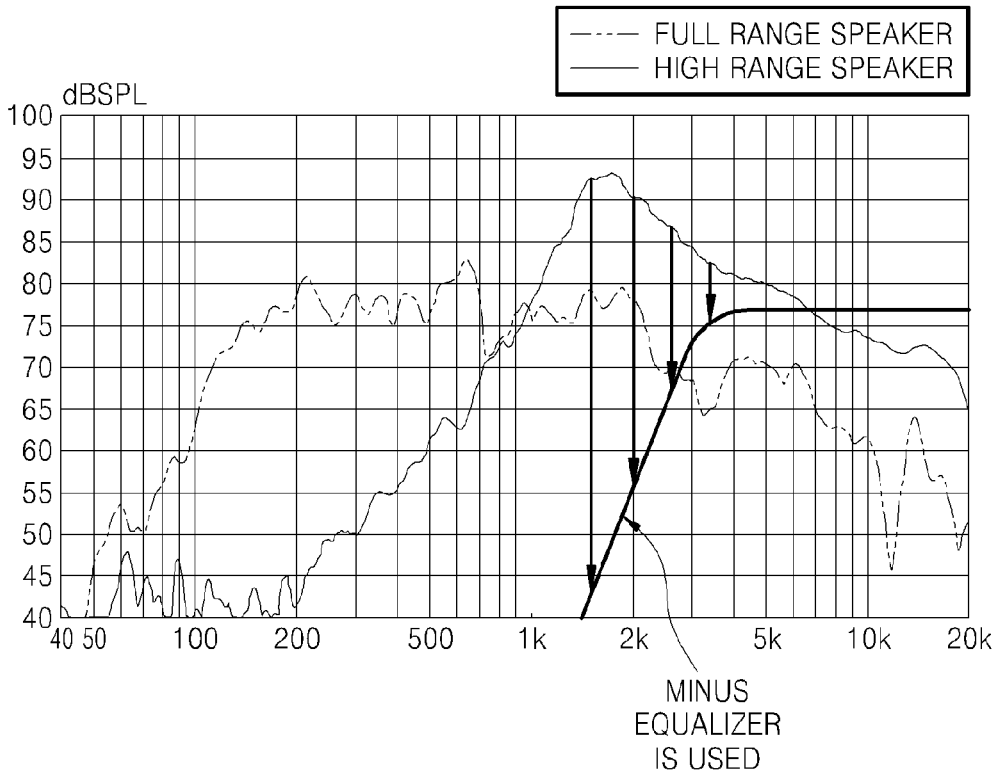
FIG. 7 is a graph showing the sound characteristics of the high range speaker and a full range speaker illustrated in FIG. 1.

FIG. 7 is a graph showing the sound characteristics of the full range speaker 12 and the high range speaker 11. The full range speaker 12 shows preeminent sound attenuation mainly in the high range. However, in the case of the high range speaker 11 that is installed at an acute off-axis angle, the attenuation in the high range is considerably reduced, and thus, uniform sound quality can be obtained in the full range by the combination of the full range speaker 12 and the high range speaker 11.

Meanwhile, when the high range speaker 11 is used as described with reference to FIG. 7, excessive amount of sound may be output in some regions of the high range. In this case, a minus equalizer 20, which is a sound signal filter, may be used to reduce signals of frequency regions corresponding to the some regions of the high range, as illustrated in FIG. 2. In this manner, very uniform and rich sound can be enjoyed for all of low, mid, and high ranges.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A hidden speaker comprising:

a high frequency range speaker configured to output high frequency range sound having a sound of 1 kHz or greater in a first direction and not being visible from a front side of an electronic product, and a full range speaker that outputs the sound reproduced by the electronic product, over a full frequency range including a low frequency range, a mid frequency range, and a high frequency range, wherein the high frequency range speaker is disposed such that the first direction forms an acute angle to a direction to the front side of the electronic product where a listener is present.

2. The hidden speaker of claim 1, wherein the high frequency range speaker further comprises:

a tweeter that outputs the high frequency range sound and the first direction is a sound output direction of the tweeter; and a horn that guides the sound output direction of the tweeter in a direction that forms the acute angle.

3. The hidden speaker of claim 2, wherein the hidden speaker is arranged such that the high frequency range sound output from the horn does not directly collide against a main body of the electronic product.

4. The hidden speaker of claim 1, further comprising a minus equalizer that reduces an amount of the high frequency range sound of sound reproduced by the electronic product.

5. The hidden speaker of claim 1, wherein the electronic product is a digital TV.

6. The hidden speaker of claim 5, wherein the high frequency range speaker is installed at a bottom of the digital TV so that sound output at the acute angle is reflected on a surface on which the digital TV is placed and transmitted to the listener.

7. A sound reproduction method of a display apparatus, the method comprising:

displaying an image on a display apparatus;

first outputting by a high frequency sound generating unit of the display apparatus, high frequency sound having a sound of about 1 kHz or greater; and second outputting by the display apparatus, full range sound;

wherein the high frequency sound generating unit is disposed at a side of the display apparatus and not visible by a viewer of the display apparatus, wherein the first outputting of the high frequency sound is more toward the viewer than the second outputting of the full range sound.

8. The sound reproduction method of claim 7, wherein the first outputting is in a first direction, and wherein the first direction and a direction of the viewer form an acute angle.

9. A hidden speaker comprising:

a high frequency range speaker configured to output high frequency range sound in a first direction and not visible from a front side of an electronic product, wherein the high frequency range speaker is disposed such that the first direction forms an acute angle to a direction to the front side of the electronic product where a listener is present, and the high frequency range speaker is installed at a bottom of the electronic product so that the high frequency range sound output at the acute angle is reflected on a surface on which the electronic product is placed and transmitted to a listener.

* * * * *